United States Patent [19]

Pan

[11] 4,210,255

[45] Jul. 1, 1980

[54] SELF-VENTING END UNIT FOR PRESSURE PACKAGING

[75] Inventor: Peter N. Y. Pan, Country Club Hills, Ill.

[73] Assignee: The Continental Group, Inc., New York, N.Y.

[21] Appl. No.: 921,037

[22] Filed: Jun. 30, 1978

[51] Int. Cl.³ ..... B60L 1/02

[52] U.S. Cl. ..... 220/209; 220/231; 220/359; 220/367; 220/DIG. 19; 215/260; 215/310

[58] Field of Search ..... 220/209, 231, 359, DIG. 27, 220/367, 371, 372, DIG. 19, 203; 215/310, 260, 308, 307; 206/213.1

[56] References Cited

U.S. PATENT DOCUMENTS

| | | | |
|---|---|---|---|
| 2,173,571 | 9/1939 | Jesnig | 220/231 X |
| 2,224,296 | 12/1940 | Hoffman | 220/231 X |
| 2,242,966 | 5/1941 | Burkardt | 220/367 X |
| 2,301,212 | 11/1942 | Jones | 220/203 |
| 2,429,984 | 11/1947 | Berglund | 220/367 |
| 2,933,102 | 4/1960 | Hillman et al. | 220/367 X |
| 3,369,859 | 2/1968 | Cornelius | 206/213.1 X |
| 3,621,876 | 11/1971 | Campbell | 220/209 X |
| 3,716,180 | 2/1973 | Bemiss et al. | 220/367 |

FOREIGN PATENT DOCUMENTS

| | | | |
|---|---|---|---|
| 2341905 | 2/1975 | Fed. Rep. of Germany | 220/203 |
| 405180 | 12/1965 | Switzerland | 220/231 |
| 414284 | 8/1934 | United Kingdom | 220/209 |

*Primary Examiner*—Joseph Man-Fu Moy

*Attorney, Agent, or Firm*—Charles E. Brown

[57] ABSTRACT

An end unit intended for packaging products in an associated can or container wherein the product is of the type producing gases so as to normally increase the internal pressure within the can after the closing of the can. The end unit has a vent opening therethrough and is normally closed by a closure member which is held in contact with the container wall surrounding the vent opening by a strip of stretchable material having a memory. When pressure within the container exceeds a predetermined pressure, the closure will move out of the container sealing position under the restraint of the strip, and the container will be vented to the atmosphere.

8 Claims, 2 Drawing Figures

SELF-VENTING END UNIT FOR PRESSURE PACKAGING

This invention relates to new and useful improvements in container construction, and more particularly to a container which is particularly adapted to receive a product which generates gas and wherein gaseous build-up within the container is to be held to a minimum.

During the packaging of such gasing products as coffee, the product is packed under vacuum conditions. As a result, when the container is removed from the vacuum atmosphere, external pressures are placed on the container with the result that relatively thick metal is required. For example, in the packaging of coffee in a vacuum of approximately 28 inches of water, gauge, the body wall of the container must have a thickness on the order of 0.010 to 0.013 inch depending upon container size and whether it is beaded to prevent paneling during the vacuum packaging cycle.

When coffee is packed under vacuum conditions, subsequently the roasting coffee outgases $CO_2$ in quantities such that the internal pressure rises to about 2 p.s.i. gauge.

It has been found that liquid $N_2$ or $CO_2$ pellets added to a container during product filling and closing will elevate the vacuum packaging leading to a reduction in thickness of the body to one on the order of 0.066 inch. However, the resultant internal pressure rises to 15-20 p.s.i. gauge and presents two major disadvantages:

1. On opening, the fine coffee grains "aerosol", causing coffee to be sprayed about the area.

2. The standard profile end unit bulges and/or buckles under these internal pressures.

In the past, an attempt has been made to package coffee with the liquid $N_2$ and $CO_2$ added, with the result that the so-packed coffee exhibits superior odor, flavor, etc. Unfortunately, the high cost of packaging and the aerosoling effect caused the product to be removed from the market.

In order that coffee may be packaged under pressure conditions in order to obtain the superior flavor, it is proposed to provide a container which permits the removal of oxygen from the coffee while at the same time permitting the use of much thinner metal stock for the formation of the container body.

In accordance with this invention, the problem of excessive internal pressure is solved by providing an operable vent which is actuated at low pressures, on the order of 2 p.s.i. gauge.

Most specifically, it is proposed to provide the container wall (end panel) with a vent opening which has associated therewith a closure. The closure is held in pressure sealing contact with the container wall by a strip of stretchable material having a memory. This stretchable material, when applied, will place a closing force on the closure corresponding approximately to the force of 2 p.s.i. gauge.

It is proposed that the strip of stretchable material hold the closure in sealing engagement with the container wall until there is a build-up of pressure within the container, after which the strip stretches and permits momentary venting of the interior of the container. The elastic limit of the strip not being exceeded, and the strip having a memory, after the internal pressure is relieved, the closure will again be forced back into sealing engagement with the container wall thereby closing the vent opening.

With the above and other objects in view that will hereinafter appear, the nature of the invention will be more clearly understood by reference to the following detailed description, the appended claims, and the several views illustrated in the accompanying drawings.

IN THE DRAWINGS

Figure 1:
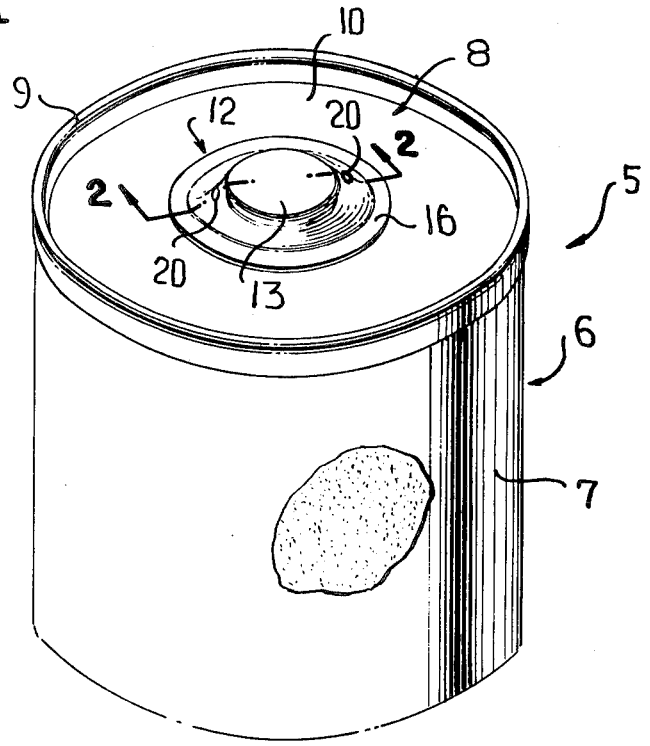
FIG. 1 is a fragmentary top perspective view of a can incorporating an end unit having a vent arrangement in accordance with this invention.

Referring now to the drawings in detail, it will be seen that there is illustrated a package wherein a product is packed under low pressure conditions. The package is generally identified by the numeral 5 and includes a can or like container generally identified by the numeral 6. The can 6 has a conventional body 7, the lower end of which (not shown) is closed in any conventional manner. The upper end of the body 7 is closed by a self-venting end unit generally identified by the numeral 8. The end unit 8 is preferably secured to the upper end of the body 7 by a conventional double seam 9 and includes a recessed end panel 10.

All features of the container 6 described to this point are conventional. The end panel 10, however, is provided with a vent opening 11 which is illustrated as being centrally located, but may be in any desired location on the end panel.

Figure 2:
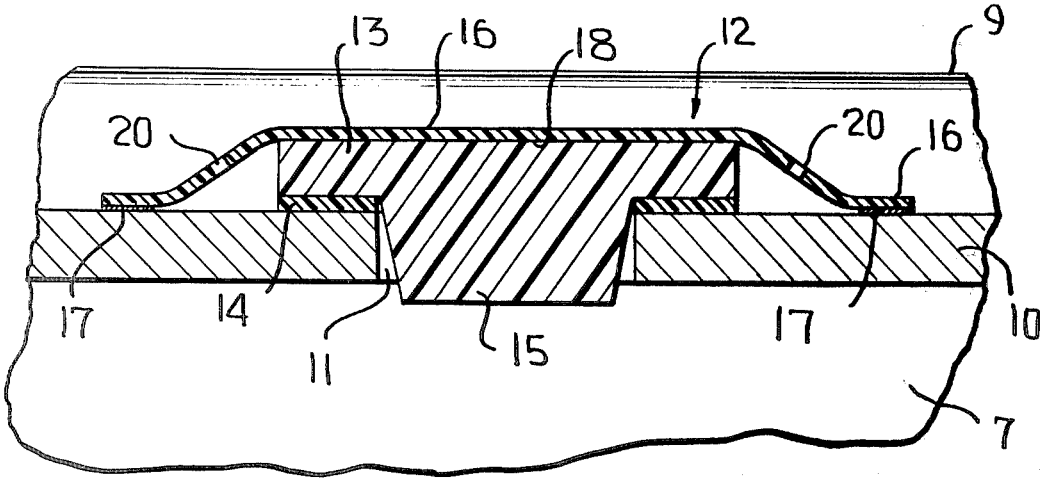
FIG. 2 is an enlarged fragmentary vertical sectional view taken generally along the line 2—2 of FIG. 1, and shows more specifically the details of the venting apparatus.

The vent opening 11 is normally closed by a venting closure assembly generally identified by the numeral 12. Referring now primarily to FIG. 2, it will be seen that the vent opening 11 is normally closed by a closure member 13. The closure member 13 either seats directly on the end panel 10 surrounding the vent opening 11, or a suitable gasket 14 may be provided. The gasket 14 may be carried either by the closure 13 or the end panel 10, and is provided to assure a seal between the closure 13 and the end panel 10 under low pressure or force conditions.

Primarily for the purpose of maintaining the closure 13 aligned with the vent opening 11, a plug 15 extends from the underside of the closure down through the vent opening 11. The primary purpose of the plug 15 is to maintain the closure 13 in alignment with the vent opening 11.

The closure 13 is normally held relative to the end panel 10 so that a seal is effected between the closure 13 and the end panel 10. This holding of the closure 13 is accomplished by means of a strip of stretchable material, the strip being generally identified by the numeral 16. The strip 16 is adhesively bonded as at 17 to the end panel surrounding the vent opening 11 so that all escaping gases must pass through the strip 16. The strip 16 is also preferably bonded to the upper surface of the closure 13 by adhesive 18.

It is to be understood that the strip 16 is to hold the closure 13 in a pressurized seating relationship with respect to the end panel 10. Accordingly, the strip 16 is formed of a plastic material having a memory. The strip 16 is preferably formed of a polymer adhesive mesh. The strip 16 is compounded of a plastics material which, when applied, will exert a pressure on the closure member 13 such that an internal pressure within the container 6 greater than about 2 p.s.i. gauge is required to unseat the closure 13. The materials which may be utilized to form the strip 16 include a loose weave Lycra type material having polypropylene and Hercoprime as both the adhesive and host material for the Lycra type material. It is to be understood, however, that there are many other rubberized or formulated adhesive meshes would could be utilized.

It is to be understood that when the closure 13 becomes unseated, pressure from within the container 6 is vented to the atmosphere through vent passages 20 in the strip. These vent passages are preferably passages which result from the loose weave of the material, but may be specially formed vent openings or passages.

In accordance with this invention, the container 6 is filled with coffee or a like product under atmospheric conditions and than a bellet of either liquid $N_2$ or $CO_2$ is applied. It is to be understood that the $N_2$ or $CO_2$ vaporizes and functions to drive entrapped air out of the container. With the removal of the air, particularly when the product which is packed is coffee, superior flavor, odor, etc. can be obtained.

It is to be understood that the coffee or other product is initially packaged at atmospheric pressures and, therefore, no special container construction is required to prevent the container from collapsing or buckling under external pressures. On the other hand, when the container is packed under atmospheric conditions, large amounts of air are entrapped within the container with this air having a reaction with the coffee. On the other hand, the introduction of the inert gas to the container and the eventual driving out of the air provides for a much higher quality product. As the gassing of the coffee occurs, any pressure build-up within the container above the setting of the vent means will result in the temporary unseating of the closure relative to the end panel and the driving off of air.

Although only a preferred embodiment of the invention has been specifically illustrated and described herein, it is to be understood that minor variations may be made in the container construction without departing from the spirit and scope of the invention as defined by the appended claims.

I claim:

1. A venting container component comprising a container wall having a vent opening therethrough, a closure seated on said container wall and normally closing said vent opening, said closure projecting above said container wall, and an elastic retainer means extending from said closure remote from said container to said container wall in a state holding said closure seated on said container wall only under predetermined limited positive internal pressure conditions, said elastic retainer means having elasticity properties and a memory sufficient to reseat said closure on said container wall at container internal pressures less than said predetermined pressure.

2. The venting container component of claim 1 wherein said elastic retainer means has a continuous bond with said container wall, and said elastic retainer means having vent passages therethrough intermediate said closure and said container wall.

3. The venting container component of claim 1 wherein said closure has a plug portion extending into said vent opening for guiding said closure during movement thereof while venting.

4. The venting container component of claim 1 wherein there is a gasket disposed between said closure and said container wall.

5. The venting container component of claim 1 wherein said container component is an end unit and said container wall is an end panel.

6. The venting container component of claim 5 wherein said end unit is part of a closed can having a product packed therein.

7. The venting container component of claim 6 wherein said product is coffee and said container has an inert gas therein under low pressure.

8. The venting container component of claim 1 wherein said elastic retainer means includes a stretchable material and an adhesive mesh.

* * * * *